US005669339A

United States Patent [19]

Yukawa et al.

[11] Patent Number: 5,669,339

[45] Date of Patent: Sep. 23, 1997

[54] CYLINDER COOLING APPARATUS OF MULTI-CYLINDER ENGINE

[75] Inventors: Masaji Yukawa; Masahiro Aketa; Kazutoshi Okamoto; Yasukazu Kamada; Akira Hayatani; Masahiko Sugimoto; Nobuhiro Yamamoto, all of Sakai, Japan

[73] Assignee: Kubota Corporation, Osaka, Japan

[21] Appl. No.: 608,076

[22] Filed: Feb. 28, 1996

[30] Foreign Application Priority Data

| | | | |
|---|---|---|---|
| Mar. 20, 1995 | [JP] | Japan | 7-060818 |
| Jul. 18, 1995 | [JP] | Japan | 7-181215 |
| Aug. 18, 1995 | [JP] | Japan | 7-210383 |

[51] Int. Cl.[6] ..... F02F 1/14; F02F 7/00

[52] U.S. Cl. ..... 123/41.79; 123/195 R

[58] Field of Search ..... 123/41.79, 195 R

[56] References Cited

U.S. PATENT DOCUMENTS

| | | | |
|---|---|---|---|
| 3,659,569 | 5/1972 | Mayer et al. | 123/41.79 |
| 4,794,884 | 1/1989 | Hilker et al. | 123/41.79 |
| 5,188,071 | 2/1993 | Han | 123/41.79 |

FOREIGN PATENT DOCUMENTS

| | | |
|---|---|---|
| 0 068 179 | 1/1983 | European Pat. Off. . |
| 56-42744 | 10/1981 | Japan . |
| 59-7242 | 1/1984 | Japan . |
| 59-68155 | 5/1984 | Japan . |
| 59-107946 | 7/1984 | Japan . |
| 62-173534 | 11/1987 | Japan . |
| 63-253156 | 10/1988 | Japan . |

*Primary Examiner*—Thomas N. Moulis

*Attorney, Agent, or Firm*—Lowe, Price, LeBlanc & Becker

[57] ABSTRACT

A water passage forming member (10) embedded in a connection wall (4) between adjacent bores (3a) (3a) of a multi-cylinder (2) by a casting process is provided with a pair of left and right vertical jacket communication passages (12)(12) for making cylinder jackets (8)(8) within a cylinder block (1) communicate with a head jacket (22), cooling water passages (15) arranged vertically and in multiple stage for making the paired jacket communication passages (12) (12) communicate with each other, and non-hollow portions (11) arranged in multiple stage and alternately with the cooling water passages (15). A pair of left and right cooling water induction portions (13)(13) are disposed in the lower portions of the jacket communication passages (12)(12) and opened toward the cylinder jackets (8)(8), and the paired left and right cooling water induction portions (13)(13) are constructed by spreading a pair of fore and rear cooling water guiding plates (14)(14) projected leftward and rightward, along the respective external circumferential surfaces (3a) (3a) of adjacent fore and rear cylinders (3)(3).

9 Claims, 12 Drawing Sheets

CYLINDER COOLING APPARATUS OF MULTI-CYLINDER ENGINE

BACKGROUND OF THE INVENTION

1. Field of the Invention

The present invention relates to a cylinder cooling apparatus of a multi-cylinder engine, and more specifically to a technology of embedding a chaplet for constructing a water passage forming member in a connection wall between adjacent cylinder bores of a multi-cylinder engine by the casting process so as to intensively cool a head side portion of the connection wall by making the cooling water flow through the water passage forming member.

2. Background of the Related Art

Recently, there has been adopted a multi-cylinder engine in which a distance between adjacent cylinder bores is shortened because the downsizing and weight-decreasing is required for such multi-cylinder engines or in which a connection wall between adjacent cylinders is thinned as much as possible to enlarge cylinder bores because the increasing of a stroke volume is required to accomplish higher outputs of such engines.

As for such a conventional technology, there have been known, for example a one (referred to as a first conventional example hereinafter) disclosed in the Japanese Patent Publication No. Sho 56-42744, a one (referred to as a second conventional example hereinafter) disclosed in the Japanese Utility Model Laid Open Publication No. Sho 59-68155, and a one (referred to as a third conventional example hereinafter) further disclosed in the Japanese Utility Model Laid Open Publication No. Sho 59-1107946.

FIGS. 10(A), 10(B) and 10(C) show the first conventional example; FIG. 10(A) is a vertical sectional view of a principal portion of the multi-cylinder thereof; FIG. 10(B) is a horizontal sectional plan view taken along the B—B directed line in FIG. 10(A); and FIG. 10(C) is a perspective view of a water passage forming member embedded by the casting process in a connection wall between adjacent bores of the multi-cylinder.

In this first conventional example, a plurality of cylinders 53 are arranged side by side in a front and rear direction in a cylinder block 51, a multi-cylinder 52 is constructed by connecting the adjacent cylinders 53, 53 to each other through a connection wall 54, cylinder jackets 58 are formed so as to enclose the multi-cylinder 52, and a water passage forming member 110 is embedded in the connection wall 54 by the casting process. As shown in FIGS. 10(A), 10(B) and 10(C), the water passage forming member 110 is provided with a cooling water passage 115 which is vertically elongated and flat in its vertical sectional side view, and the cylinder jackets 58, 58 on the left and right opposed sides of the head side portion 54*a* are constructed so as to communicate with each other through the cooling water passage 115.

As shown in FIG. 10(B), the cylinder jackets 58, 58 are extended near to the left and right opposed outsides of the head side portion 54*a* of the connection wall 54, so that the cooling water inducted from one side of the cooling water passage 115 flows through the cooling water passage 115 to cool the head side portion 54*a*. Incidentally, bosses 55, 55 for a pair of left and right bolts 56, 56 for use in the tightening of a cylinder head (not illustrated) are disposed outside the cylinder jackets 58, 58. Herein, projecting engagement portions 114, 114 projected from the left and right opposed end portions of the water passage forming member 110 are used for reliably securing the water passage forming member 110 to a core for a cylinder jacket at the time of manufacturing the core.

In the first conventional example, since the left and right opposed end portions and the projecting engagement portions 114, 114 of the cooling water passage 115 are projected into the cylinder jackets 58, 58, they obstruct the smooth flowing of the cooling water tending to flow along a cylinder external circumferential surface 53*b* and also the flowing thereof into the cooling water passage 115. Therefore, there exists a disadvantage that the head side portion 54*a* of the connection wall 54 can not be cooled intensively by the cooling water.

Further, since the cooling water passage 115 is flat and longitudinally elongated, a portion corresponding to the cooling water passage 115 becomes short of strength when machining the cylinder bore 53*a* and, resultantly it is apprehended that local distortions might be produced in the cylinder bore 53*a*. In order to avoid that, it is necessary to increase thickness of the connection wall 54 to a certain extent. That is, since the thickness of the connection wall 54 can not be reduced satisfactorily, there exists a difficulty in an intent to largely increase an output power of the engine by shortening a distance between the cylinder bores 53*a* or by increasing a stroke volume.

In addition, since the left and right cylinder head tightening bosses 55, 55 are disposed outside the cylinder jackets 58, 58, there also exists a disadvantage that the cylinders 53 can't be tightened strongly and uniformly along its circumferential direction because a distance between the left and right head bolts 56, 56 becomes longer.

FIGS. 11(A), 11(B) and 11(C) show the second conventional example; FIG. 11(A) is a vertical sectional view of a principal portion of the multi-cylinder thereof; FIG. 11(B) is a horizontal sectional plan view taken along the B—B directed line in FIG. 11(A); and FIG. 11(C) is a perspective view of a water passage forming member embedded in a connection wall of the multi-cylinder by the casting process.

As shown in FIGS. 11(A), 11(B) and 11(C), the water passage forming member 110 is provided with a pair of left and right vertical jacket communication passages 112, 112 for making left and right cylinder jackets 58, 58 within a cylinder block 51 communicate with a head jacket (not illustrated), a cooling water passages 115 for making the paired left and right jacket communication passages 112, 112 with each other and a pair of left and right cooling water induction portions 113, 113 disposed at the lower portions of the respective cylinder jacket communication passages 112, 112 and opened toward the respective cylinder jackets 58, 58.

The cooling water inducted from the cooling water induction portions 113, 113 flows through the cooling water passage 115 and flows out into the head jacket (not illustrated) disposed above the head side portion 54*a* of the connection wall 54, through the jacket communication passages 112, 112 to cool the head side portion 54*a* meanwhile. Incidentally, the cylinder head tightening bosses 55, 55 disposed on the left and right sides of the head side portion 54*a* of the connection wall 54 are disposed outside the cylinder jackets 58, 58 similarly to the first conventional example.

In the above-mentioned second conventional example, though the cooling water induction portions 113 are formed by cutting out the lower portions of the tubes which construct the respective jacket communication passages 112, openings of the cooling water induction portions 113 are small. Therefore, there exists a disadvantage that the head side portion 54a of the connection wall 54 can't be cooled intensively because a great deal of cooling water can't be smoothly inducted into the cooling water passage 115.

Further, since the cooling water passage 115 is flat and longitudinally elongated and thus the thickness of the connection wall 54 can't be reduced satisfactorily similarly to the first conventional example, there exists a difficulty in an intent to largely increase an output power of the engine by shortening a distance between the cylinder bores 53a or by increasing a stroke volume.

Moreover, since the left and right cylinder head tightening bosses 55, 55 are disposed outside the cylinder jackets 58, 58, similarly to the first conventional example, there also exists a disadvantage that the cylinders 53 can be tightened strongly and uniformly along its circumferential direction because a distance between the left and right head bolts 56, 56 becomes longer.

FIGS. 12(A), 12(B) and 12(C) show the third conventional example. FIG. 12(A) is a vertical sectional view of a principal portion of the multi-cylinder thereof. FIG. 12(B) is a horizontal sectional plan view taken along the B—B directed line in FIG. 12(A), and FIG. 12(C) is a perspective view of a water passage forming member embedded in a connection wall of the multi-cylinder by the casting process.

Also in this third conventional example, a plurality of cylinders 53 are arranged side by side in a front and rear direction in a cylinder block 51, a multi-cylinder 52 is constructed by connecting the adjacent cylinders 53, 53 to each other through a connection wall 54, cylinder jackets 58 are formed so as to enclose the multi-cylinder 52, and a water passage forming member 110 is embedded in the connection wall 54 by the casting process.

As shown in FIGS. 12(A) , 12(B) and 12(C), the water passage forming member 110 is provided with a pair of left and right jacket communication passages 112, 112, a pair of left and right cooling water induction openings 113, 113 formed in the lower portions of the respective jacket communication passages 112, 112 and opened toward the respective cylinder jackets 58, 58, and a pair of left and right cooling water passages 115 brought into communication with the respective jacket communication passages 112 and with the cooling water induction openings 113. These cooling water passages 115 are formed flat in the front view, elongated in the vertical sectional side view and like bags so as to make the cooling water within the cylinder jackets 58 flow out into the head jacket through the cooling water induction openings 113, the cooling water passages 115 and the jacket communication passages 112 orderly to cool the head-side portion 54a of the connection wall 54 meanwhile.

The water passage forming member 110 is constructed by forming two sheet metal bodies 110a, 110a through a forming die and securing non-hollow portions 111, 111 each in the shape of horizontally directed H to each other. But joint portions 117 formed outside the left and right jacket communication passages 112, 112 are merely superposed one on another and not fixedly secured to each other. The two fore and rear sheet metal bodies 110a, 110a are not symmetrical because the joint portions 117 are different in configuration.

In the third conventional example, since the cooling water passages 115 are flat and vertically elongated and thus the thickness of the connection wall 54 can not be reduced satisfactorily similarly to the first conventional example, there exists a difficulty in an intent to largely increase an output power of the engine by shortening a distance between the cylinder bores 53a or to increase the stroke volume.

Further, in the third conventional example, since the openings of the cooling water induction openings 113 are small similarly to the second conventional example, it is impossible to smoothly induct a great deal of cooling water into the cooling water passages 115.

That is, in all of the first through third conventional examples, since the thickness of the connection wall 54 cannot be reduced satisfactorily, it is impossible to shorten the distance between the cylinder bores 53a. Further, there exists a disadvantage that the head side portion 54a of the connection wall 54 cannot be cooled intensively. In this way, since the head side portion 54a of the connection wall 54 cannot be cooled intensively, the increasing of the engine output power cannot be accomplished due to the decreasing of radiating capability.

That is, though the piston rings are cooled through the cylinder wall, when the radiating capability of the head side portion 54a is low, especially the top ring should be mounted a certain distance away from the piston top-surface in consideration of preventing the seizing and the like of the piston ring. This means that an annular dead space which does not contribute to combustion is provided around the external circumference of the piston top portion. Therefore, it is impossible to improve the air utilizing ratio, and resultantly it is also impossible to accomplish the increasing of the engine output power.

A diesel engine needs a gas sealing pressure of at least about 900 $Kg/cm^2$ due to its high compression ratio. In all of the first through third conventional examples, since the distance between the cylinder head tightening bosses 55, 55 is large and thus the cylinders 53 cannot be tightened uniformly and strongly along the circumferential direction, it is impossible to increase the gas sealing pressure sufficiently in the case of application to the diesel engine.

Especially in recent years, it has been required to further promote the downsizing and weight decreasing of the engine and to accomplish the increasing of output power thereof. Since the first through third conventional examples have the above-mentioned disadvantages, they cannot answer these requirements satisfactorily. The present invention is directed to answering these requirements and has for its tasks a) to accomplish the further downsizing and weight decreasing of a multi-cylinder engine and the further increasing of the output power thereof by reducing the thickness of the connection wall to the utmost, and b) to improve the air utilizing ratio to accomplish the increasing of the engine output power by cooling the head side portion of the connection wall more intensively to relocate the top ring more upward of the piston.

SUMMARY OF THE INVENTION

A cylinder cooling apparatus of a multi-cylinder engine according to the present invention has the following fundamental construction, for examples as shown in FIGS. 1(A) and 1(B).

A plurality of cylinders 3 are arranged side by side in a front and rear direction in a cylinder block 1, a multi-cylinder 2 is constructed by connecting the adjacent cylinders 3, 3 to each other through a connection wall 4, cylinder jackets 8 are formed so as to enclose the multi-cylinder 2, and a water passage forming member 10 is embedded in the connection wall 4 by the casting process, so that the cooling water within the cylinder jackets 8, 8 can flow out into a head jacket 22 disposed above the head side portion 4a of the connection wall 4, through cooling water passages 15 formed in the water passage forming member 10 and jacket communication passages 12, 12 orderly.

In order to accomplish the above-mentioned tasks, the present invention has the characterizing constitutions mentioned below.

In the cylinder cooling apparatus of the multi-cylinder engine having the above-mentioned fundamental construction, the water passage forming member 10 is provided with a pair of left and right vertical jacket communication passages 12, 12 for bringing the cylinder jackets 8, 8 within the cylinder block 1 into communication with the head jacket 22, the cooling water passages 15 arranged vertically and in multiple stage for bringing the paired left and right jacket communication passages 12, 12 into communication with each other, and non-hollow portions 1 arranged in multiple stage and alternately with the cooling water passages 15.

According to the present invention, the non-hollow portions 11 formed vertically and in multiple stage in the water passage forming member 10 serve as ribs for mechanically reinforcing the connection wall 4. That is, the cooling water passages 15 formed vertically and in multiple stage as well as alternately with the non-hollow portions 11 increase the mechanical strength remarkably in comparison with the flat vertically elongated cooling water passage 115 of the conventional examples. Thereby, it is not apprehended that partial distortions are produced during the boring of the cylinder bore 3*a*.

Since the non-hollow portions 11 formed vertically and in multiple stage mechanically reinforce the connection wall 4, the water passage forming member 10 can be thinned to the utmost and as a result the connection wall 4 can be thinned to the utmost. Thereby, the distance between the cylinder bores can be shortened by making the thickness of the connection wall 4 thinner than those of the conventional examples. Otherwise, the increasing of the stroke volume and as a result the increasing of the output power can be accomplished by enlarging a diameter of the cylinder bore.

The cooling water within the cylinder jackets 8, 8 flows smoothly along the cylinder external circumferential surface 3*a* and escapes into the head jacket 22 disposed above the connection wall 4, through the cooling water passages 15 and the jacket communication passages 12. Meanwhile, most of the cooling water flows through the cooling water passages 15 in the upper half portion to intensively cool the head side portion 4*a*. Thus, the piston rings can be cooled intensively through the cylinder wall. Thereby, it becomes possible to accomplish the increasing of the engine output power as follows.

a) Since the piston rings can be cooled intensively through the cylinder wall, it becomes possible to relocate the top ring nearer to the piston top surface as much as possible and to decrease an annular dead space around the external circumference of the piston top portion, which does not contribute to combustion, as much as possible to improve the air utilizing ratio. Further, along with this, it becomes possible to preclude the seizing of the top ring which might be caused by an unburnt portion of the fuel and carbonization of the lubrication oil.

b) Along with the relocation of the top ring nearer to the piston top surface as much as possible, the position of the piston pin can be relocated nearer to the piston top surface as much as possible to enlarge the rotation radius of a crank shaft correspondingly by that neared length. Therefore, it becomes possible to increase the piston stroke and as a result the stroke volume without modifying the physique (height) of a connecting-rod engine. That is, it becomes possible to accomplish the relative downsizing of the multi-cylinder engine and the increasing of the engine output power.

c) On the contrary, in case where the piston stroke is not changed, since the length of the connecting-rod can be set longer correspondingly by an amount by which the position of the piston pin is relocated nearer to the piston top surface, it becomes possible to decrease a piston side thrust, which results in accomplishing the decrease of the friction loss.

d) Further, since the head side portion can be cooled intensively, it becomes possible to reduce the thickness of the head side portion. Therefore, it becomes possible to increase the stroke volume and as a result the engine output power by enlarging the diameter of the cylinder bore correspondingly by that thinned amount.

BRIEF DESCRIPTION OF THE DRAWINGS

FIG. 1(A) is a vertical sectional view of a principal portion of a cylinder block having the water passage forming member embedded therein by the casting process;

FIG. 1(B) is a partial plan view of the cylinder block;

FIG. 2(A) is a perspective view of the water passage forming member;

FIG. 2(B) is a vertical sectional view taken along the B—B directed line in FIG. 2(A);

FIG. 2(C) is a horizontal sectional plan view taken along the C—C directed line in FIG. 2(A);

FIG. 4(A) is a perspective view of the water passage forming member;

FIG. 4(B) is a plan view showing a sectional right half portion of the water passage forming member;

FIG. 4(C) is a vertical sectional view taken along the C—C directed line in FIGS. 4(A) and 4(B);

FIG. 5(A) is a partial vertical sectional view of the cylinder block;

FIG. 5(B) is a partial plan view of the cylinder block;

FIG. 6(A) is a perspective view of the water passage forming member;

FIG. 6(B) is a vertical sectional front view of the water passage forming member;

FIG. 7(A) is a perspective view of the water passage forming member;

FIG. 7(B) is a front view of the water passage forming member;

FIG. 8(A) shows a first variant of the water passage forming member;

FIG. 8(B) shows a second variant of the water passage forming member;

FIG. 10(A) is a vertical sectional view of a principal portion of a multi-cylinder of a vertical engine;

FIG. 10(B) is a horizontal sectional plan view taken along the B—B directed line in FIG. 10(A);

FIG. 10(C) is a perspective view of a water passage forming member;

FIG. 11(A) is a vertical sectional view of a principal portion of a multi-cylinder of a vertical engine;

FIG. 11(B) is a horizontal sectional plan view taken along the B—B directed line in FIG. 11(A);

FIG. 11(C) is a perspective view of a water passage forming member;

FIG. 12(A) is a vertical sectional view of a principal portion of a multi-cylinder of a vertical engine;

FIG. 12(B) is a horizontal sectional plan view taken along the B—B directed line in FIG. 12(A); and FIG. 12(C) is a perspective view of a water passage forming member.

DESCRIPTION OF THE PREFERRED EMBODIMENTS

A first embodiment of the present invention will be explained hereinafter with reference to the attached drawings.

Figure 3:
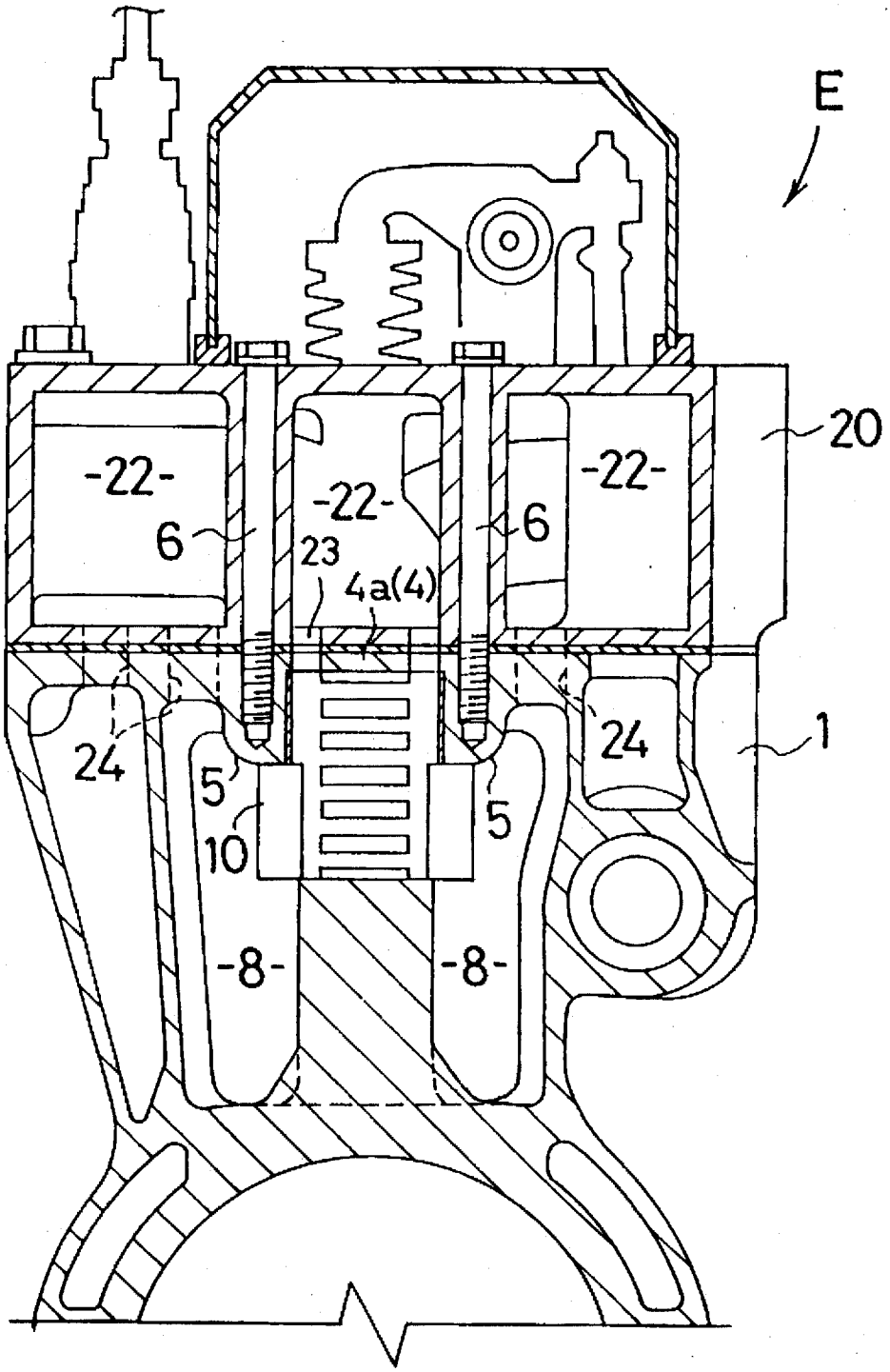
FIG. 3 is a vertical sectional view of a principal portion of a vertical multi-cylinder engine in which the water passage forming member according to the first embodiment is embedded by the casting process.

FIG. 3 is a vertical sectional view of a principal portion of a vertical multi-cylinder engine having a water passage forming member according to the first embodiment of the present invention embedded therein by a casting process.

As shown in FIG. 3, a vertical multi-cylinder engine E has a cylinder head 20 fixedly secured by head bolts 6 onto a cylinder block 1 integrally formed with a crankcase, cylinder jackets 8 formed in the cylinder block 1 and a head jacket 22 formed in the cylinder head 20 being brought into communication with each other through many jacket communication ports 24 formed in portions except a connection wall 4 to cool the cylinder head 20 by the cooling water which has already cooled the cylinder block 1.

Figure 1A:
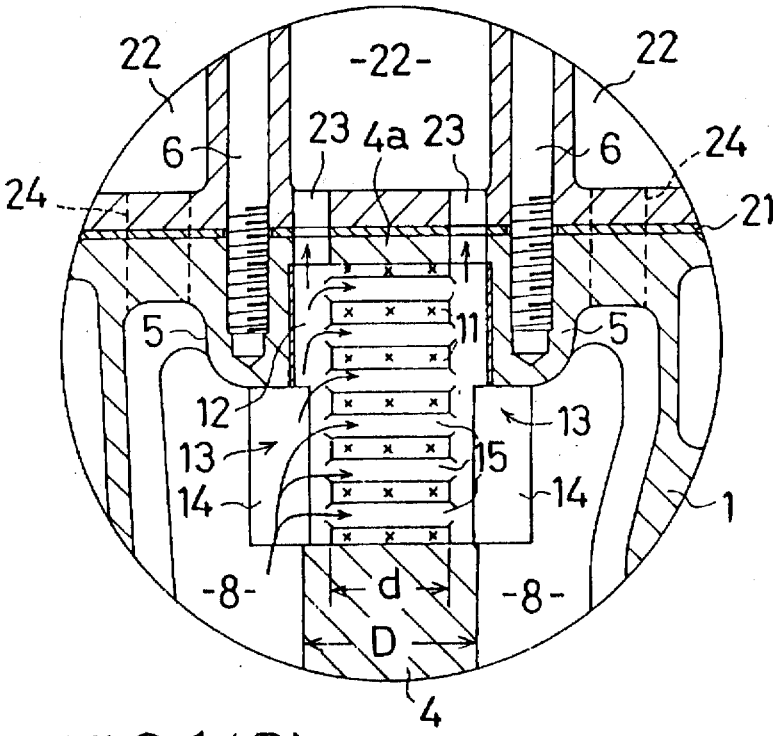
FIGS. 1(A) and 1(B) show a cylinder block in which a water passage forming member according to a first embodiment of the present invention is embedded by a casting process.
Figure 1B:
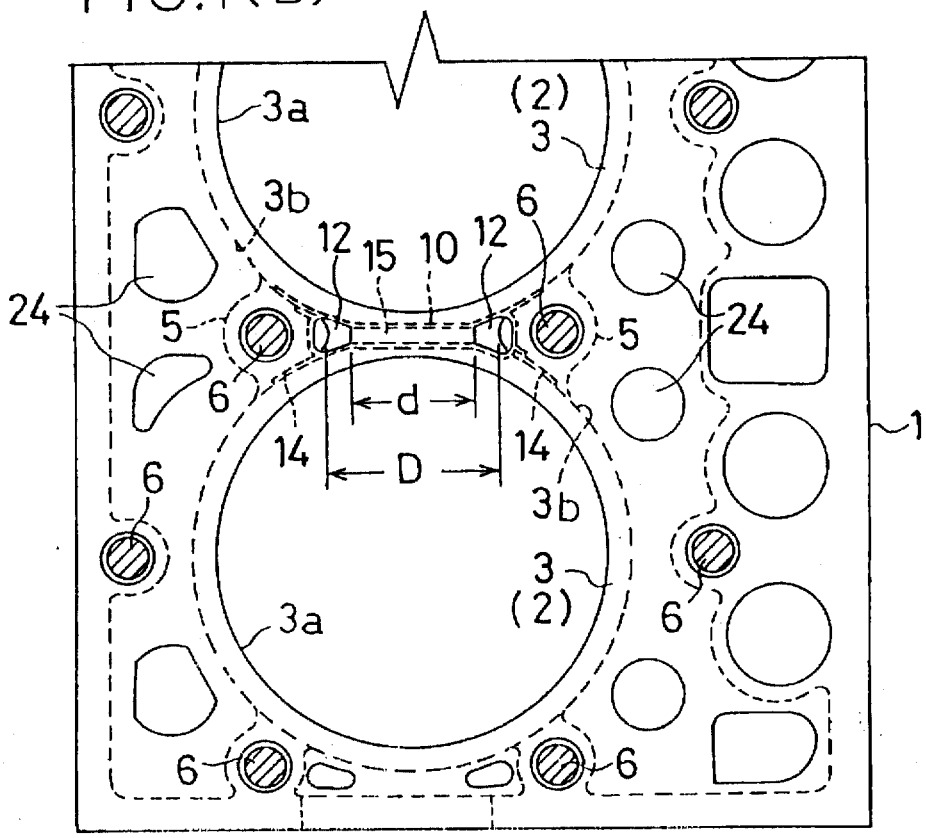

As shown in FIGS. 1(A) and 1(B) as well as in FIG. 3, a cylinder cooling apparatus of a multi-cylinder engine according to the present invention has a multi-cylinder 2 constructed by arranging a plurality of cylinders 3 in the cylinder block 1 side by side in a front and rear direction and connecting the adjacent cylinders 3, 3 through a connection wall 4, and also it has the cylinder jackets 8 formed so as to surround the multi-cylinder 2. The water passage forming member 10 to be explained later is embedded in the connection wall 4 by the casting process.

Now, characteristic constructions of the first embodiment will be explained hereinafter.

Figure 2A:
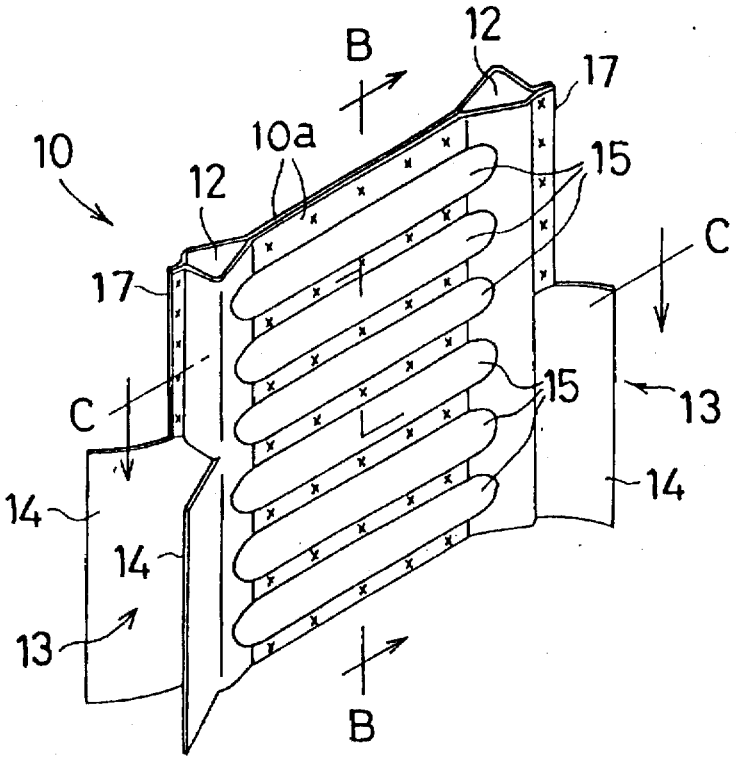
FIGS. 2(A), 2(B) and 2(C) show the water passage forming member according to the first embodiment of the present invention.
Figure 2B:
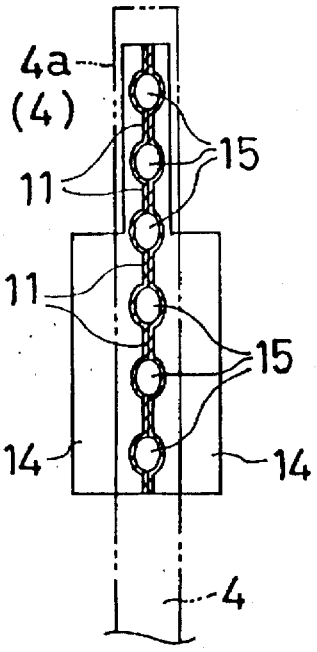
Figure 2C:
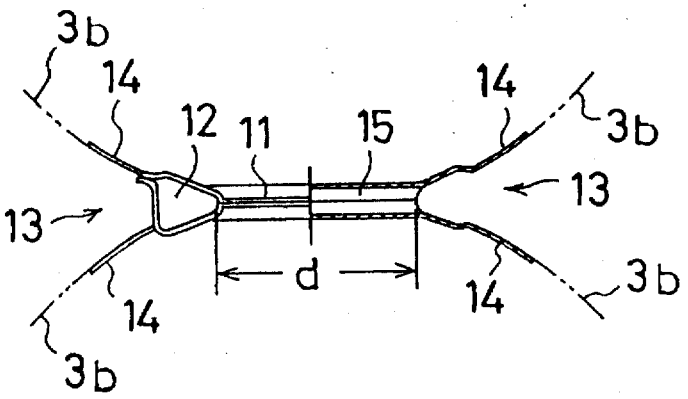

As shown in FIGS. 2(A), 2(B) and 2(C), the water passage forming member 10 is constructed by superposing two press-formed sheet metal bodies 10*a*, 10*a* one on another while facing each other and connecting their mutual joint portions by means of seam welding to form an integral construction. Thereby, it can be manufactured readily by merely securing the two sheet metal bodies 10*a*, 10*a* formed in the same configuration to each other.

The water passage forming member 10 is provided with a pair of left and right vertical jacket communication passages 12, 12 for bringing cylinder jackets 8, 8 within a cylinder block 1 into communication with a head jacket 22, cooling water passages 15 arranged vertically and in multiple stage for bringing the paired left and right jacket communication passages 12, 12 into communication with each other, and non-hollow portions 11 arranged in multiple stage and alternately with the cooling water passages 15. The lower portions of the paired left and right jacket communication passages 12, 12 are formed as a pair of cooling water induction portions 13, 13 opened toward the respective cylinder jackets 8, 8, so that a great deal of cooling water inducted from the cooling water induction portions 13, 13 can flow through the cooling water passages 15 and flow out into the head jacket 22 disposed above the head side portion 4*a*through the jacket communication passages 12, 12.

When the non-hollow portions 11 and the cooling water passages 15 are formed vertically and in multiple stage as well as arranged alternately with each other as disclosed in the above-mentioned embodiment, the non-hollow portions 11 serve as ribs for mechanically reinforcing the connection wall 4 and provide such an advantage that they can effectively cope with a pressurizing force acting on the connection wall 4 during the machining of cylinder bores or the engine operation in comparison with the case where the cooling water passage 15 is formed longitudinally elongated and flat in the vertical sectional side view like that in the first conventional example.

That is, the plural cooling water passages 15 formed vertically and in multiple stage as well as alternately with the non-hollow portions 11 increase the mechanical strength remarkably in comparison with the flat longitudinally elongated cooling water passage 115 of the conventional example. Thereby, it is not apprehended that local distortions are produced during the boring of the cylinder bore 3*a*.

Since the multi-stage and non-hollow portion 11 reinforces the connection wall 4 mechanically, the water passage forming member 10 can be thinned to the utmost and as a result the connection wall 4 can be thinned to the utmost. Thereby, the distance between the cylinder bores can be shortened by reducing the thickness of the connection wall 4 more than that of the conventional example. Otherwise, the increasing of the stroke volume and as a result the increasing of the output power can be accomplished by enlarging a diameter of the cylinder bore.

A pair of left and right cylinder head tightening bosses 5, 5 are formed continuously with the opposed left and right side portions of the head side portion 4a to narrow intervals between the head bolts 6, 6, so that the cylinders 3 can be tightened more uniformly and strongly by that narrowed amount along the circumferential direction. Incidentally, though the present invention is not limited to this construction, when the pair of left and right cylinder head tightening bosses 5, 5 are formed continuously with the opposed left and right side portions of the head side portion 4a, advantageously it becomes possible to enlarge jacket communication ports 23 formed in the upper end wall of the cylinder block 1 and bores of the paired jacket communication passages 12, 12, thereby enabling a great deal of the cooling water to flow therethrough.

The paired jacket communication passages 12, 12 are disposed inside of the bosses 5, 5 and are in communication with the jacket communication ports 23 formed in the upper end wall of the cylinder block 1 as well as in the lower end wall of the cylinder head 20. As shown in FIGS. 1 (A) and 1(B), a lateral dimension d of the cooling water passages is set smaller than a lateral dimension D of the connection wall 4. Thereby, the interval d between the inside edges of the openings of the paired jacket communication passages 12, 12 can be set smaller than the lateral dimension D of the connection wall 4. Accordingly, since the interval between the paired left and right head bolts 6, 6 can be narrowed by that narrowed amount of the interval d between the inside edges of the openings of the jacket communication passages 12, 12 to increase the number of the head bolts 6 arranged around the cylinder 3, it becomes possible to tighten the cylinders 3 more uniformly and strongly along the circumferential direction thereof. Thereby, it becomes possible to increase the gas sealing pressure.

The paired left and right cooling water induction portions 13, 13 are constructed by spreading a pair of fore and rear cooling water guide plates 14, 14 projected leftward and rightward, along the respective external circumferential surfaces 3a, 3a of the adjacent fore and rear cylinders 3, 3 respectively. Since openings of the cooling water induction portions 13, 13 can be formed large by the above-mentioned construction, most of the cooling water flows into the cooling water passages 15 and the jacket communication passages 12 from the cooling water induction portions 13, 13 spread toward the cylinder jackets 8, 8 and then escapes into the head jacket 22 disposed above the connection wall 4, through the jacket communication passages 12, 12. Meanwhile, a great deal of the cooling water flows through the cooling water passages 15 in the upper half portion and the jacket communication passages 12, 12 to cool the head side portion 4a intensively. Thereby, the increasing of the engine stroke volume and as a result the increasing of the output power can be accomplished.

That is, since the piston ring can be cooled intensively through the cylinder wall by cooling the head side portion 4a intensively, it becomes possible to relocate the top ring nearer to the piston top surface as much as possible and to reduce the annular dead space as much as possible which exists around the external circumference of the piston top portion and which doesn't contribute to the combustion, thereby improving the air utilizing ratio. Thus, along with this, it becomes possible to preclude the seizing of the top ring which might be caused by an unburnt portion of the fuel and carbonization of the lubrication oil.

Further, along with the relocation of the top ring nearer to the piston top surface as much as possible, the position of the piston pin can be relocated nearer to the piston top surface as much as possible to enlarge a rotation radius of a crank shaft correspondingly by that neared length. Therefore, it becomes possible to accomplish the relative downsizing of the connecting rod engine without modifying the engine physique and the increasing of the engine output power by enlarging the piston stroke. Since the head side portion 4a can be cooled intensively, it becomes also possible to accomplish the increasing of the stroke volume by enlarging the diameter of the cylinder bore. Further, when the present invention is also applied to a multi-cylinder engine or the like equipped with a turbocharger, it becomes possible to accomplish the relative downsizing and the increasing of the engine output power.

Figure 4A:
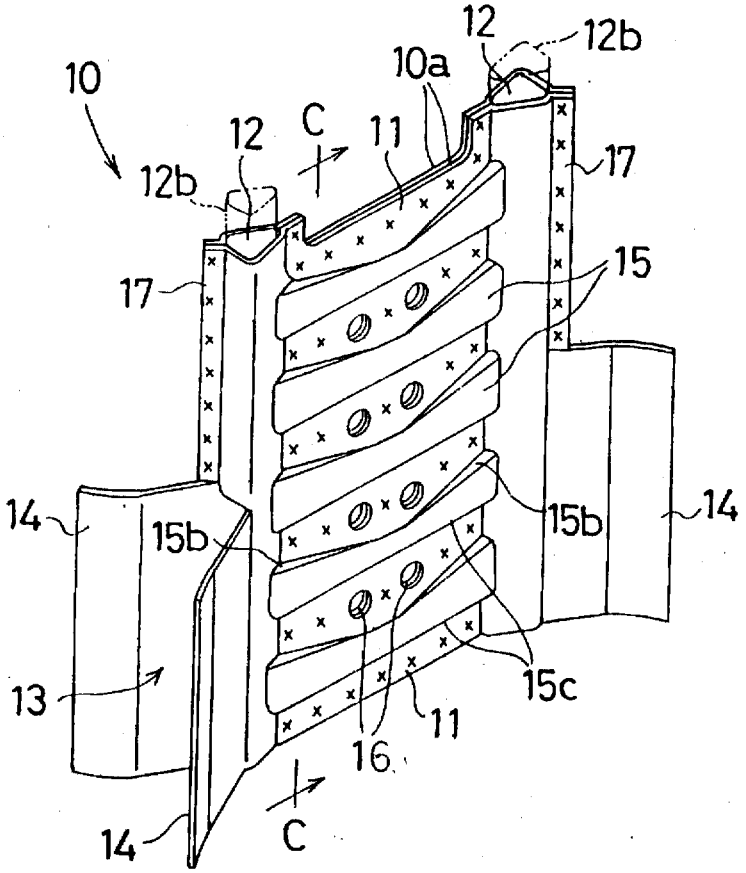
FIGS. 4(A), 4(B) and 4(C) show a water passage forming member according to a second embodiment of the present invention.
Figure 4B:
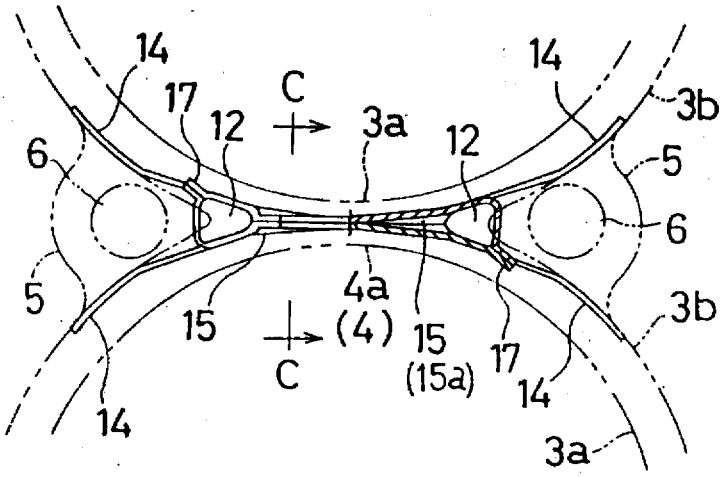
Figure 4C:
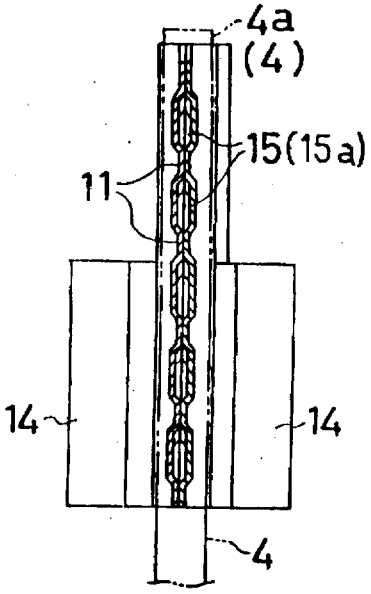
Figure 5A:
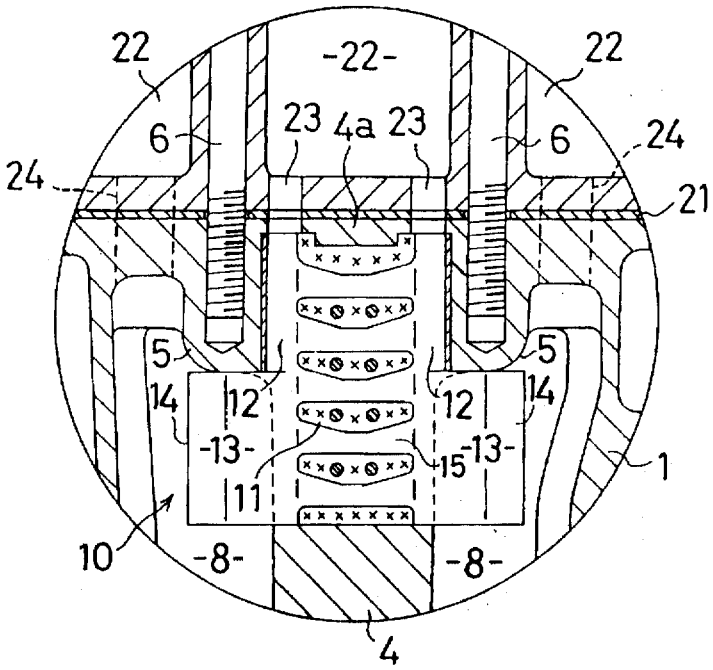
FIGS. 5(A) and 5(B) show a principal portion of a cylinder block in which the water passage forming member according to the second embodiment is embedded by the casting process.
Figure 5B:
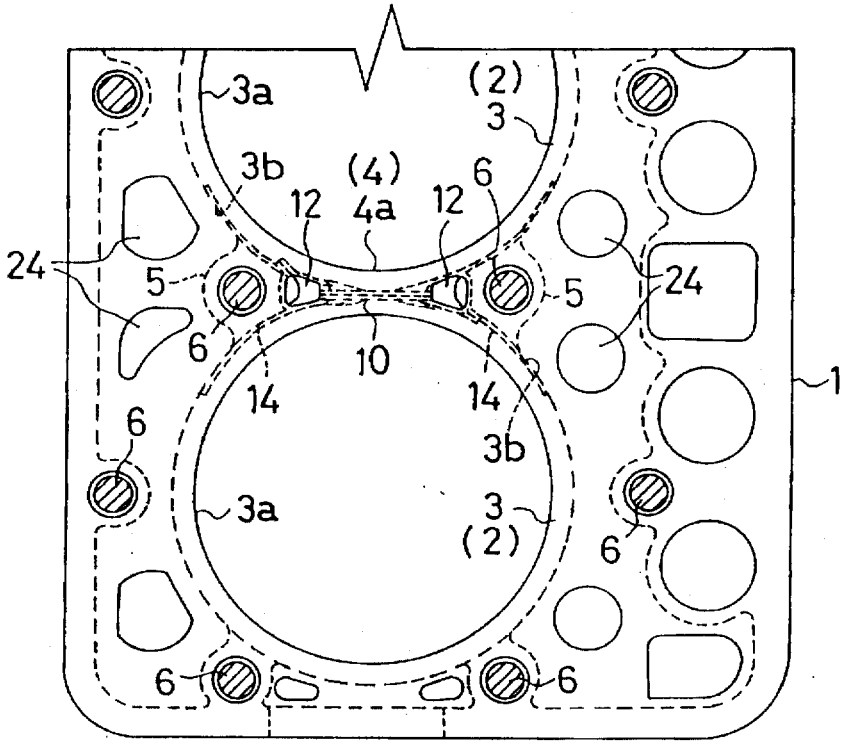

FIGS. 4(A), 4(B) and 4(C) show a water passage forming member according to the second embodiment of the present invention, and FIGS. 5(A) and 5(B) show the principal portion of the cylinder block in which the water passage forming member is embedded by the casting process.

As illustrated in the drawings, similarly to the first embodiment, the water passage forming member 10 is formed into an integral construction by superposing two sheet metal bodies 10a, 10a, which are formed symmetrically in a front and rear direction by means of a press forming die, one on another while opposing each other and then securing the non-hollow portions 11, 11 arranged vertically and in multiple stage to one another and also vertical outer edge joint portions 17, 17 projected outward from the outer edges of the left and right jacket communication passages 12, 12 to one another by means of seam welding. Constructions of the second embodiment different from those of the first embodiment will be explained hereinafter, and redundant explanations about common constructions thereof will be omitted.

In this embodiment, though the non-hollow portions 11 and the cooling water passages 15 are formed vertically and in multiple stage as well as alternately with each other, as shown in FIGS. 4(A), 4(B) and 4(C), the cooling water passages 15 have hollow portions 15a having wedge-like configurations in the plan view and formed symmetrically in a left and right direction so that their leading ends face the middles of the passages 15.

That is, though the thickness of the connection wall 4 is smallest at its mid portion and largest at its opposed end portions, when the cooling water passages 15 are formed in the wedge-like configuration in the plan view corresponding to the thickness of the connection wall 4 and symmetrically in the left and right direction so that their leading ends face the middles of the passages 15, the water passage forming member 10 can be thinned to the utmost and as a result the connection wall 4 can be thinned to the utmost. Thereby, the distance between the cylinder bores can be shortened by reducing the thickness of the connection wall 4 more than those of the conventional examples. Otherwise, the increasing of the stroke volume and as a result the increasing of the output power can be accomplished by enlarging the diameter of the cylinder bore.

As shown in FIGS. 4(A), the paired left and right cooling water passages 15 are formed acclivously outward at their upper edges 15b in the left and right directions. That is, even when steam is generated by the boiling of the cooling water within the respective cooling water passages 15, the steam moves upward along the acclivous upper edges 15b of the respective cooling water passages 15 to escape into the head jacket 22 through the jacket communication passages 12. Thereby, the cooling performance can be maintained at a high level.

One of outer edge joint portions 17 formed at the outer edges of the jacket communication passages 12, 12 is embedded by the casting process eccentrically at a position nearer to one of the cylinders 3 between the one cylinder 3 and the one cylinder head tightening boss 5, and the other outer edge joint portions 17 is embedded by the casting process eccentrically at a position near to the other cylinder 3 between the other cylinder 3 and the other cylinder head tightening boss 5. That is, since an interval between the left and right cylinder head tightening bolts 6, 6 is constant, when the joint portions 17 are superposed one on another on the outsides of the left and right jacket communication passages 12, 12 like those in the conventional examples, a substantial cross sectional area of the jacket communication passage 12 becomes small. Thereupon, as mentioned above, when the outer edge joint portions 17, 17 are disposed eccentrically nearer to one of the cylinders 3, 3 and the other, respectively, it becomes possible to increase the substantial cross sectional area of the jacket communication passage 12.

As shown in FIG. 4(B), the paired jacket communication passages 12, 12 are disposed inside of the bosses 5, 5, and as shown in FIG. 5(A), they are in communication with the jacket communication ports 23 formed in the upper end wall of the cylinder block 1 and in the lower end wall of the cylinder head 20. As shown in FIG. 4(A), the upper end portion of the jacket communication passage 12 is slightly higher than the non-hollow portion 11 at the upper edge thereof. This attempts to make sand cores 12*b* for use in forming the jacket communication ports 23 hardly break by setting the jacket communication ports 23 formed in the upper end wall of the cylinder block 1 relatively shorter.

The symbol 16 in FIG. 4(A) designates a fore and rear wall connecting port of the connection wall 4. The non-hollow portion 11 of the present invention is not limited to one having the fore and rear wall connecting ports 16. But, when the fore and rear wall connecting ports 16 are provided, there appears an advantage that the connection wall 4 can more strongly cope with a pressurizing force acting thereon during the machining of the cylinder bore or the engine operation. Configurations of the fore and rear wall connecting port 16 will be explained later.

Figure 6A:
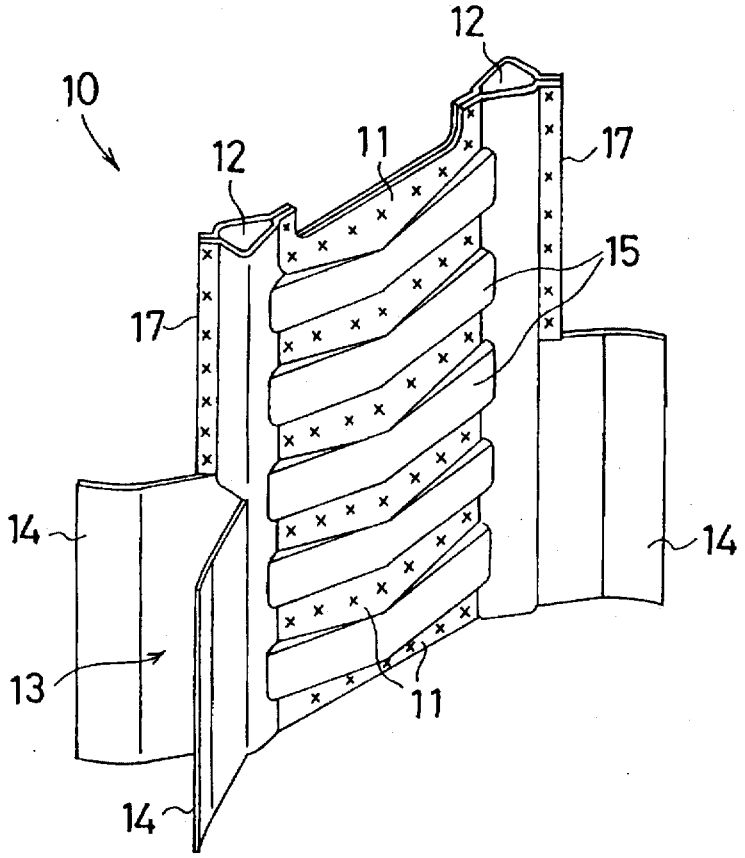
FIGS. 6(A) and 6(B) show a water passage forming member according to a third embodiment of the present invention.
Figure 6B:
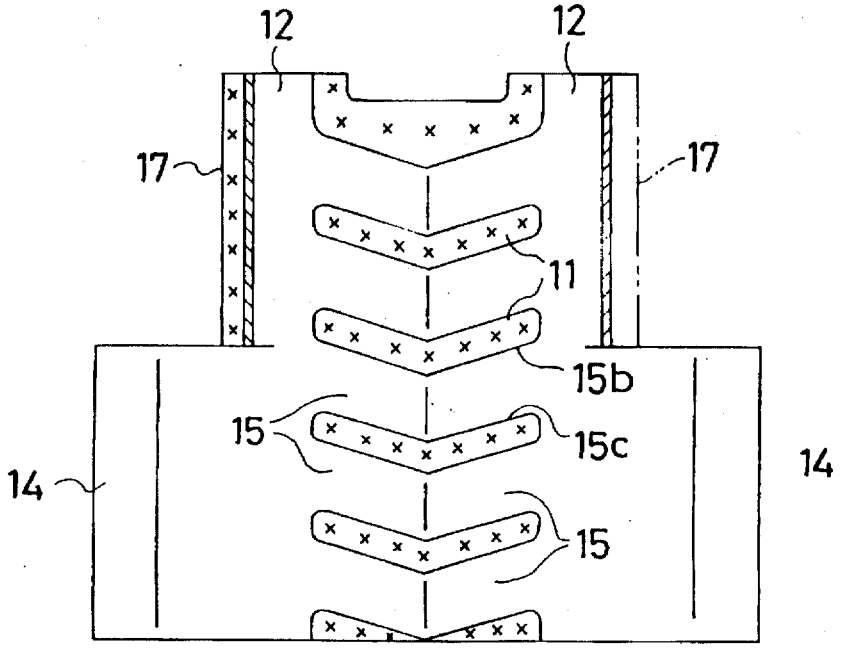

FIGS. 6(A) and 6(B) show a water passage forming member according to the third embodiment of the present invention, FIG. 6(A) is a perspective view of the water passage forming member and FIG. 6(B) is a vertical sectional front view of the water passage forming member.

In this embodiment, as illustrated in the drawings, while the non-hollow portions 11 are formed like the V-letter, upper and lower edges 15*b*, 15*c* of respective left and right wedge-like cooling water passages 15 are acclivous outward in the left and right directions. The other constructions thereof are the same as those of the second embodiment (FIG. 4(A)). That is, even when steam is generated by the boiling of the cooling water within the respective cooling water passages 15, the steam moves upward along the acclivous upper edges 15*b* of the respective cooling water passages 15 to escape into the head jacket 22 through the jacket communication passages 12. Incidentally, since it is enough to form at least the upper edge 15*b* of each of the paired left and right cooling water passages 15 acclivously outward in the left and right directions, it is optional whether the lower edge 15*c* of each of the cooling water passages 15 is formed acclivously outward in the left and right directions or not.

Figure 7A:
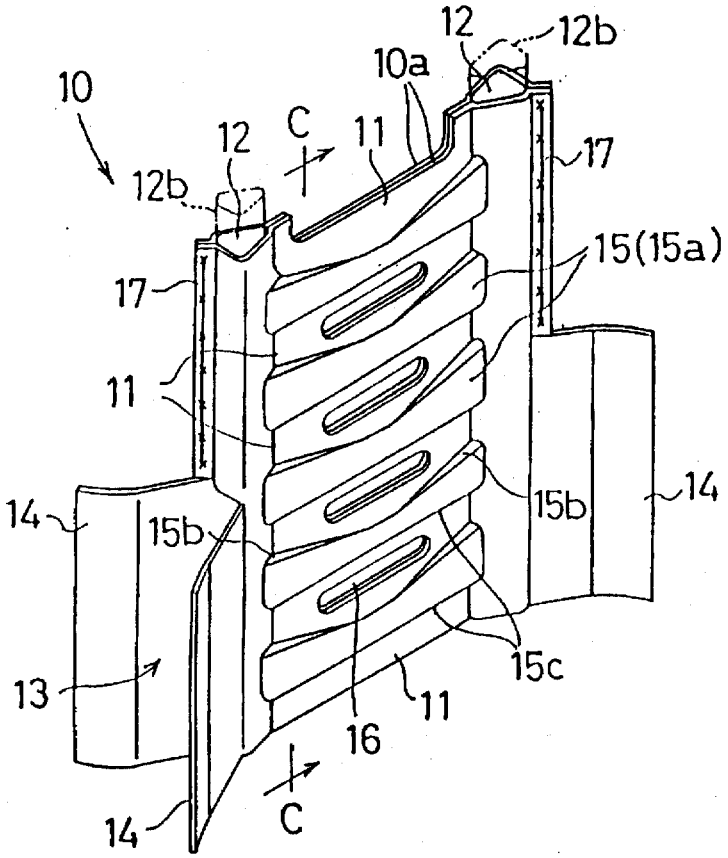
FIGS. 7(A) and 7(B) show a water passage forming member according to a fourth embodiment of the present invention.
Figure 7B:
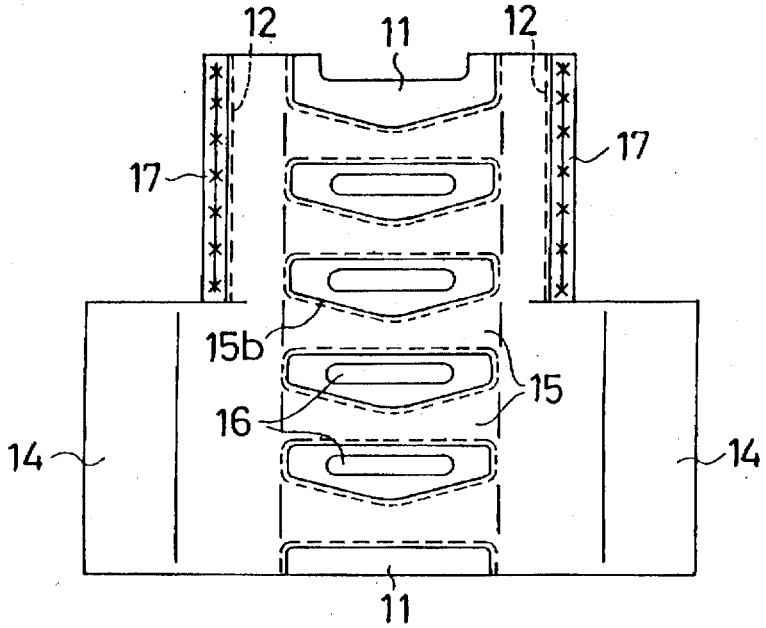

FIGS. 7(A) and 7(B) show a water passage forming member according to the fourth embodiment of the present invention. FIG. 7(A) is a perspective view of the water passage forming member and FIG. 7(B) is a front view of the water passage forming member.

In this embodiment, as illustrated in the drawings, the water passage forming member 10 is constructed as an integral unit by superposing two sheet metal bodies 10*a*, 10*a* symmetrically formed by means of a press forming die, one on another while opposing each other and securing vertical outer edge joint portions 17, 17 projected outward from the outer edges of the left and right jacket communication passages 127 12 to each other by means of seam welding. Thereby, it can be manufactured readily and inexpensively merely by securing the outer edge joint portions 17, 17 of the two sheet metal bodies 10*a*, 10*a* formed in the same configuration. Incidentally, the seam welding may be replaced with arc spot welding.

Further, in this embodiment, as illustrated in the drawings, fore and rear wall connecting ports 16 for connecting the fore and rear wall portions of the connection wall 4 to each other are opened in respective non-hollow portions 11, and the other constructions are the same as those in the second embodiment (FIG. 4(A)).

That is, since the non-hollow portions 11 have the fore and rear wall connecting ports 16 each formed like an elongated port, it becomes possible to more strongly cope with the pressurizing force acting on the connection wall 4 during the machining of the cylinder bore or the engine operation.

The non-hollow portions 11 formed vertically and in multiple stage serve as ribs for mechanically reinforcing the connecting wall 4, so that cooling water passages 15 formed vertically and in multiple stage as well as alternately with those non-hollow portions 11 can be improved remarkably in the mechanical strength when compared with the flat and vertically elongated cooling water passages 15 of the conventional examples. Thereby, it is not apprehended that local distortions are produced during the boring of the cylinder bore 3*a*.

Moreover, since upper edges 15*b* of the cooling water passages 15 are formed acclivously outward in the left and right directions, the cooling performance can be maintained at a high level. That is, even when steam is generated by the boiling of the cooling water within the respective cooling water passages 15, the steam moves upward along the acclivous upper edges 15*b* of the respective cooling water passages 15 and escapes into the head jacket 22 through the jacket communication passages 12. Thereby, the cooling performance can be maintained at a high level.

Figure 8A:
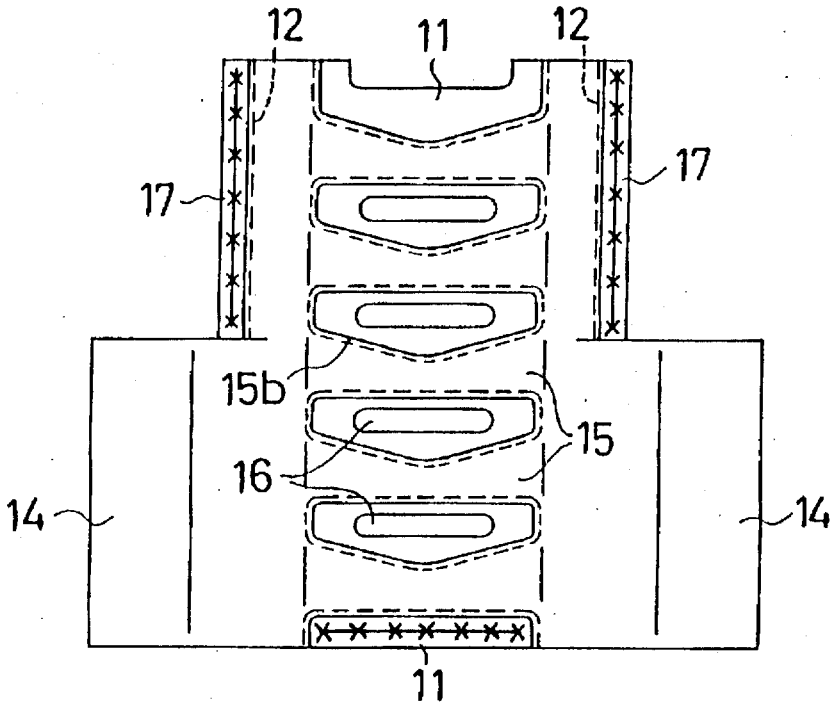
FIGS. 8(A) and 8(B) as well as FIGS. 9(A) and 9(B) are front views showing variants of the water passage forming member according to the fourth embodiment of the present invention.
Figure 8B:
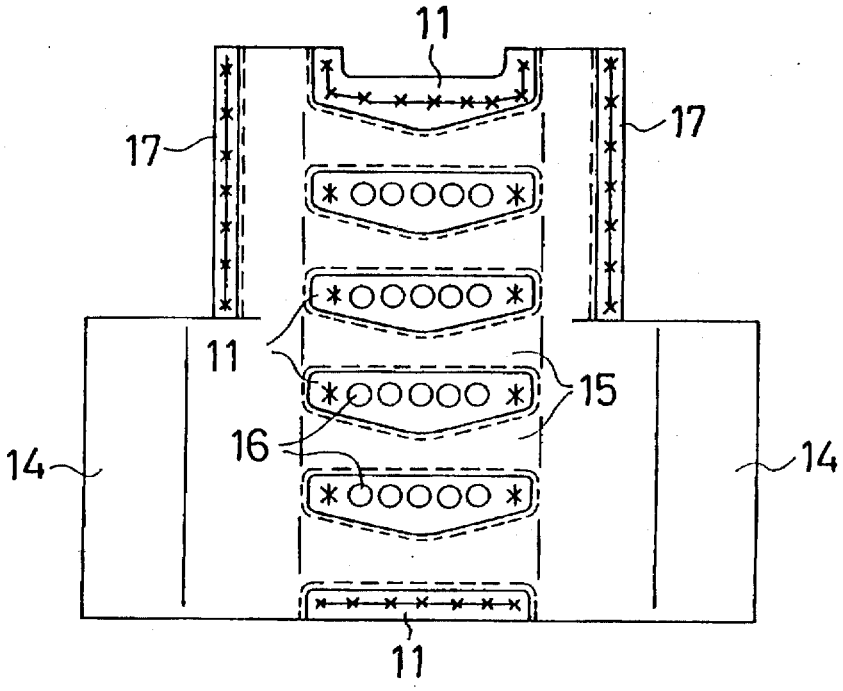
Figure 9A:
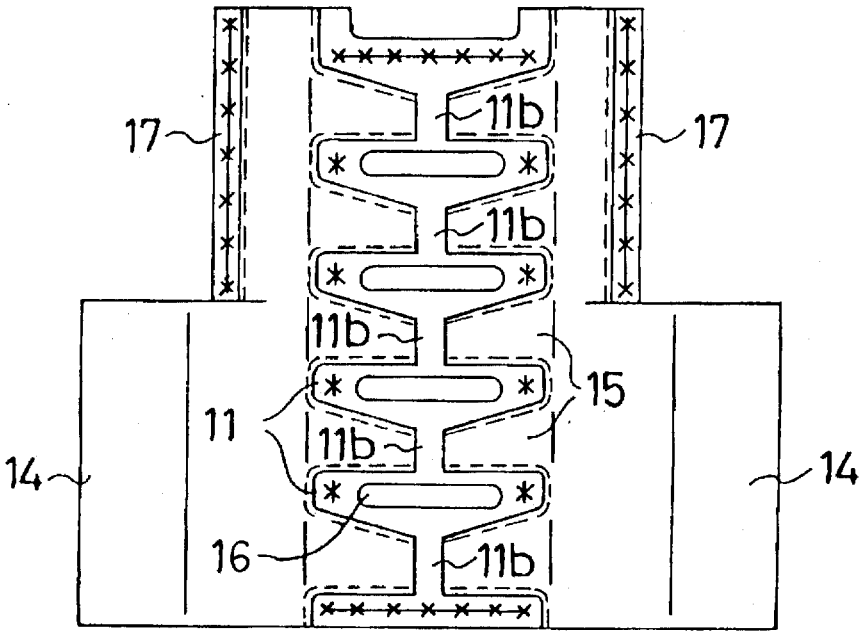
FIG. 9(A) shows a third variant of the water passage forming member.
Figure 9B:
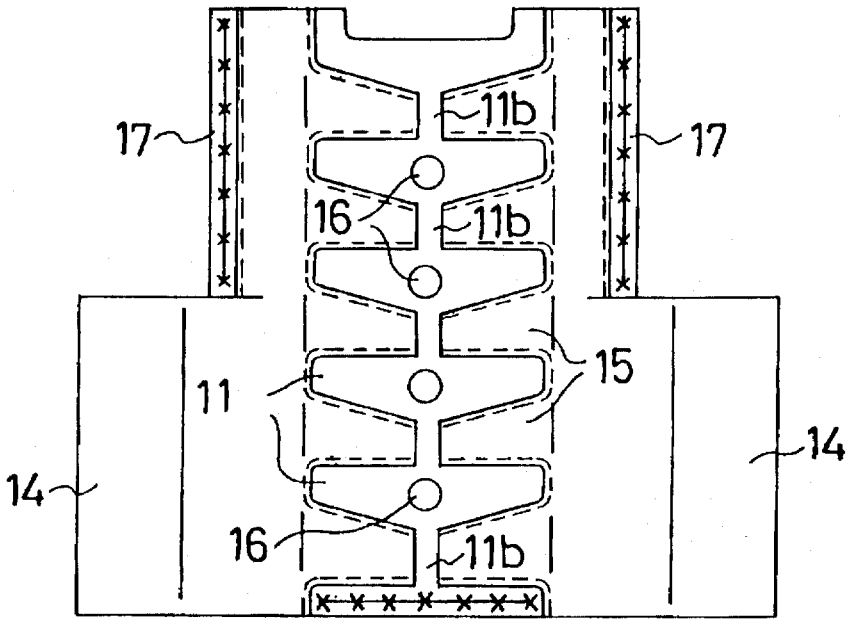
FIG. 9(B) shows a fourth variant of the water passage forming member.
Figure 10A:
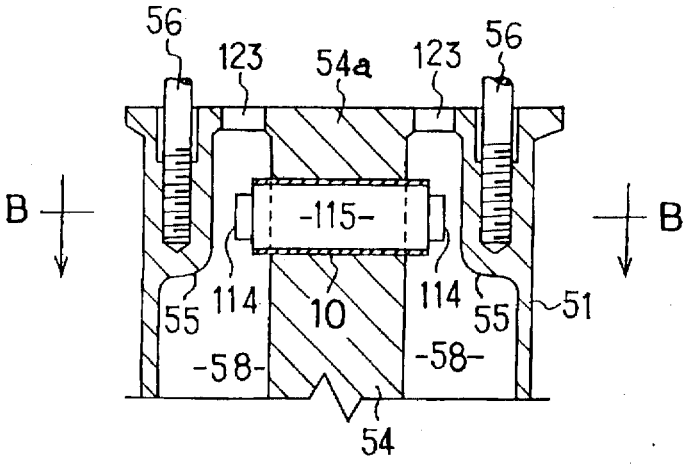
FIG.10(A) PRIOR ART
FIGS. 10(A), 10(B) and 10(C) show a first conventional example.
Figure 10B:
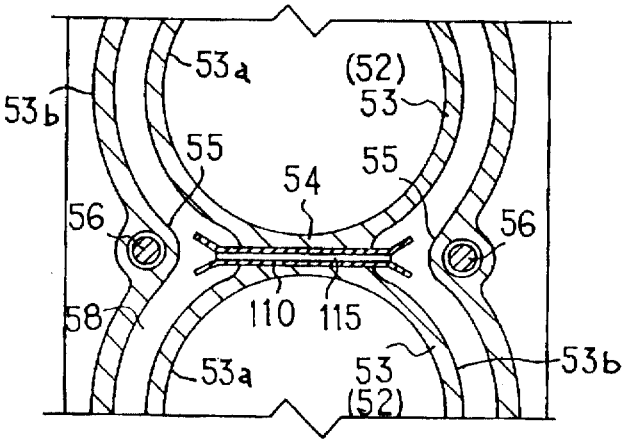
FIG.10(B) PRIOR ART
Figure 10C:
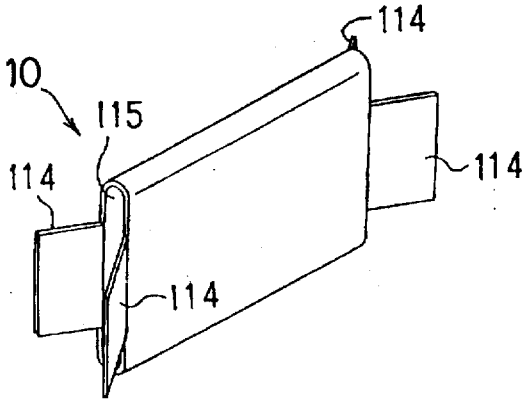
FIG.10(C) PRIOR ART
Figure 11A:
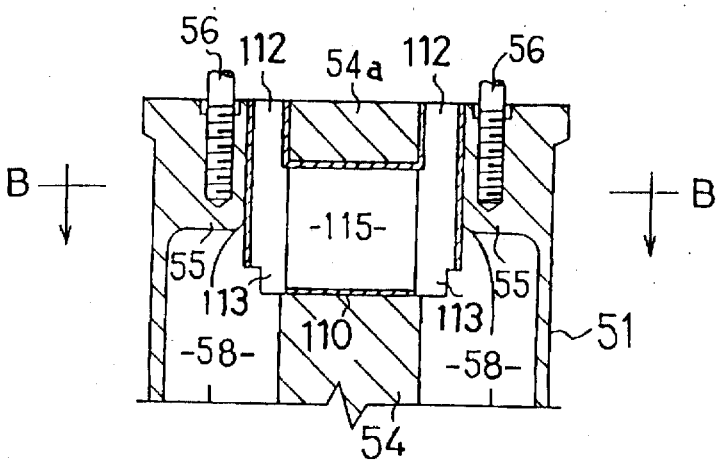
FIG.11(A) PRIOR ART
FIGS. 11(A), 11(B) and 11(C) show a second conventional example.
Figure 11B:
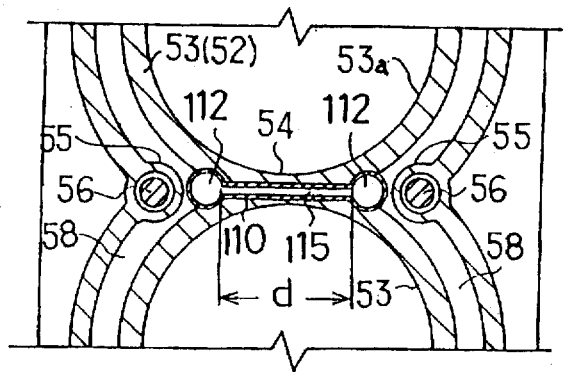
FIG.11(B) PRIOR ART
Figure 11C:
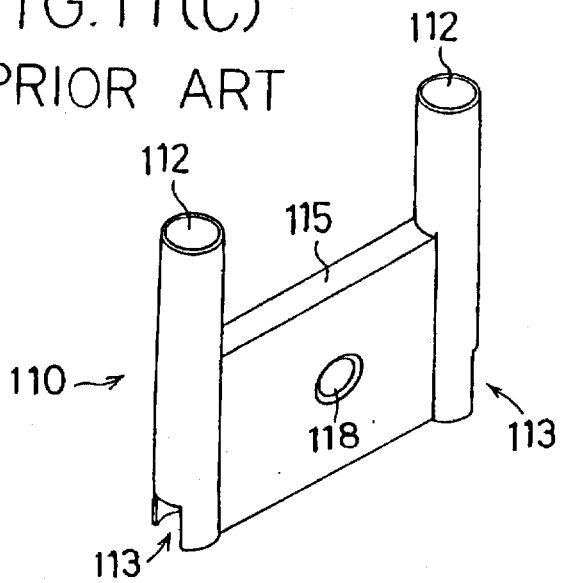
FIG.11(C) PRIOR ART
Figure 12A:
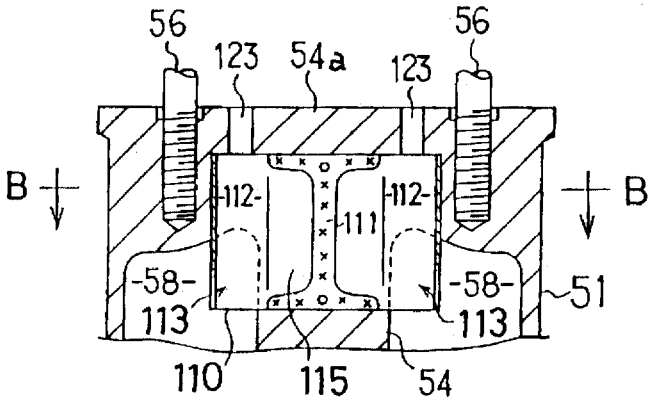
FIG.12(A) PRIOR ART
FIGS. 12(A), 12(B) and 12(C) show a third conventional example.
Figure 12B:
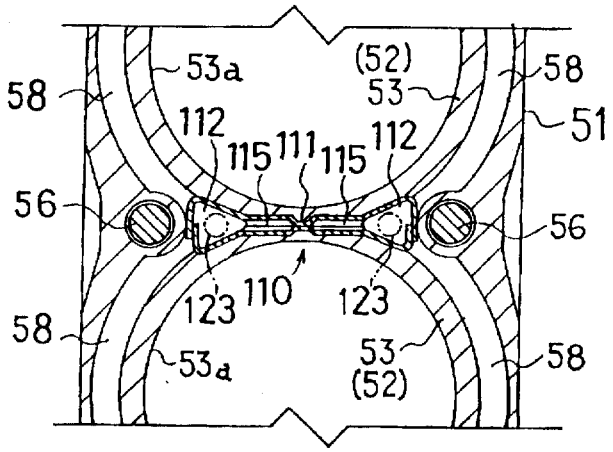
FIG.12(B) PRIOR ART
Figure 12C:
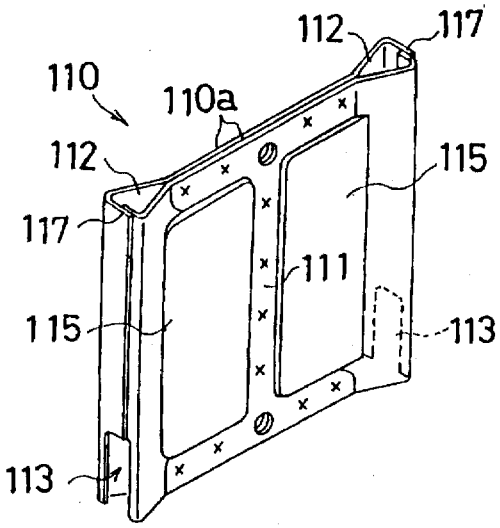
FIG.12(C) PRIOR ART

FIGS. 8(A) and 8(B) as well as FIGS. 9(A) and 9(B) are front views showing variants of the water passage forming member according to the fourth embodiment. FIG. 8(A) shows a first variant of the water passage forming member. FIG. 8(B) shows a second variant of the water passage forming member. FIG. 9(A) shows a third variant of the water passage forming member, and FIG. 9(B) shows a fourth variant of the water passage forming member.

As shown in FIG. 8(A), the first variant is constructed by integrally securing the vertical outer edge joint portions 17, 17 projected outward from the outer edges of the left and right jacket communication passages 12, 12 to each other and the lower end non-hollow portions 11 to each other by means of seam welding respectively. The other constructions are the same as those in FIG. 7(A).

As shown in FIG. 8(B), the second variant is constructed by integrally securing the vertical outer edge joint portions 17, 17 projected outward from the outer edges of the left and right jacket communication passages 12, 12 to each other and the upper and lower end non-hollow portions 11, 11 to each other by means of seam welding respectively as well as by integrally securing the non-hollow portions 11, 11 to each other by means of arc spot welding. The fore and rear wall connecting ports 16 formed in the respective non-hollow portions 11 are formed by opening a plurality of round ports at certain intervals, and the other constructions are the same as those in FIG. 7(A). Since the non-hollow portions 11, 11 are integrally secured to each other by means of the arc spot welding as mentioned above, it becomes possible to prevent gaps from being formed by intrusion of foundry sand between the non-hollow portions 11, 11.

That is, when the water passage forming member 10 is embedded in the head side portion 4*a* of the connection wall 4 by the casting process, the foundry sand is previously stuffed into the jacket communication passages 12 and the hollow portions 15 of the water passage forming member 10 Under a pressure of the highly pressurized air. But, when the non-hollow portions 11, 11 are not secured to each other, since the gaps are formed between the non-hollow portions 11, 11 by the intrusion of the foundry sand, there appears a problem that the thickness of the water passage forming member 10 becomes larger. This problem can be solved by integrally securing the non-hollow portions 11, 11 to each other by means of welding, so that the correct thickness of the water passage forming member 10 can be maintained.

As shown in FIG. 9(A), in the third variant, the non-hollow portions 11 formed vertically and in multiple stage are connected to vertical non-hollow portions 11*b* at the middle portions thereof. The fore and rear wall connecting ports 16 are formed as elongated ports in the respective non-hollow portions 11, and the other constructions are the same as those in FIG. 7(A). Incidentally, the paired left and right wedge-like cooling water passages 15 are partitioned by the vertical non-hollow portions 11*b* so as to be formed like bags each of which is shut off at the middle. Thereupon, a great deal of the cooling water flows into the paired left and right bag-like cooling water passages 15 and the left and right jacket communication passages 12 from the cooling water induction portions 13, 13 and then escapes into the head jacket 22 disposed above the connection wall 4, through the jacket communication passages 12, 12.

As shown in FIG. 9(B), in the fourth variant, the vertical outer edge joint portions 17, 17 projected outward from the outer edges of the left and right jacket communication passages 12, 12 are fixedly secured to each other by seam welding as well as the lower end non-hollow portions 11. A single round port is formed as the fore and rear wall connecting port 16 in each of the non-hollow portions 11, and the other constructions are the same as those in FIG. 7(A).

The present invention is not limited to the above-mentioned embodiments and can be embodied in various ways by optional combination with the following components (a) to (j).

a) Cooling water passages 15 each formed like a bag by the shutoff at the middle.

b) Paired left and right cooling water induction portions 13, 13 formed in the lower portions of the paired left and right jacket communication passages 12, 12 and opened toward the respective cooling jackets 8, 8.

c) Fore and rear wall connecting ports 16 formed in the non-hollow portions 11 formed vertically and in multiple stage.

d) Cooling water passages 15 constructed by arranging the hollow portions 15*a* having wedge-like configurations in the plan view with their leading ends facing the middles, symmetrically in the left and right direction.

e) Cooling water passages 15 with their upper edges 15*b* formed acclivously outward in the left and right directions.

f) The paired left and right cylinder head tightening bosses 5, 5 are formed so as to connect with the left and right opposed side portions of the head-side portion 4*a* of the connection wall 4, and the jacket communication passages 12, 12 are disposed inside of the paired cylinder head tightening bosses 5, 5.

g) Water passage forming member 10 integrally moulded by means of, for example precision casting, in place of the water passage forming member 10 constructed by integrally securing the two sheet metal bodies 10*a* to each other while opposing each other.

h) The non-hollow portions 11, 11 of the two sheet metal bodies 10*a*, 10*a* for constructing the water passage forming member are secured to each other, and the vertical outer edge joint portions 17, 17 projected outward from the outer edges of the left and right jacket communication passages 12, 12 are secured to each other.

i) The interval d between the inside edges of the openings of the paired jacket communication passages 12, 12 is set shorter than the dimension D of the connection wall 4 in the left and right direction.

j) One of the outer edge joint portions 17 is embedded by the casting process so as to be disposed eccentrically nearer to one cylinder 3 between the one cylinder 3 and the one cylinder head tightening boss 5, and the other thereof is embedded by the casting process so as to be disposed eccentrically nearer to the other cylinder 3 between the other cylinder 3 and the other cylinder head tightening boss 5.

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. A cylinder cooling apparatus of a multi-cylinder engine having a water passage forming member embedded in a connection wall between adjacent bores of a multi-cylinder block formed by a casting process, wherein:

said water passage forming member is provided with vertical left and right jacket communication passages for communicating cylinder jackets within said multi-cylinder block with a head jacket, a plurality of cooling water passages disposed in a vertical arrangement to provide communication between said left and right jacket communication passages, and a plurality of non-hollow portions arranged in alternation with said cooling water passages to separate adjacent ones of said plurality of cooling water passages.

2. The cylinder cooling apparatus according to claim 1, wherein:

said cooling water passages are blocked at their respective middle portions.

3. The cylinder cooling apparatus according to claim 1, wherein:

said water passage forming member is further provided with a pair of left and right cooling water induction portions opened toward the left and right cylinder jackets and disposed in lower portions of the left and right jacket communication passages, and said cooling water induction portions are constructed by forward and rearward spreading apart of a pair of fore and rear cooling water guide plates respectively projected along a cylinder external circumferential surface.

4. The cylinder cooling apparatus according to claim 1, wherein:

at least a fore-and-rear wall connecting port of said connection wall is formed in each of the plural non-hollow portions.

5. The cylinder cooling apparatus according to claim 1, wherein:

each cooling water passage is constructed symmetrically in a right and left direction such that it comprises hollow portions having wedge-like configurations in plan view which are arranged with their leading ends facing a middle of said water passage forming member.

6. The cylinder cooling apparatus according to claim 1, wherein:

at least an upper edge of each said cooling water passage is formed acclivously outward in the left and right directions.

7. The cylinder cooling apparatus according to claim 1, wherein:

a distance between inside edges of openings of said paired jacket communication passages is set smaller than a dimension (D) of said connection wall in the left and right directions.

8. The cylinder cooling apparatus according to claim 7, wherein:

said water passage forming member is constructed by forming two sheet metal bodies symmetrically in a front and rear direction by means of a forming die and securing said non-hollow portions arranged vertically and in a multiple stage arrangement relative to one another and also securing outer edge joint portions projected vertically outward from outer edges of said left and right jacket communication passages to one another.

9. The cylinder cooling apparatus according to claim 8, wherein:

the left and right opposed side portions of a head side portion of said connection wall are connected to the a pair of left and right cylinder head tightening bosses; and one of said outer edge joint portions is embedded by the casting process at a position near to one of said cylinders between one cylinder and a corresponding one cylinder head tightening boss, and the other of said outer edge joint portions is embedded by the casting process at a position near to the other cylinder between the other cylinder and the other of said cylinder head tightening.

* * * * *